US006278355B1

(12) United States Patent
Hopkinson et al.

(10) Patent No.: US 6,278,355 B1
(45) Date of Patent: Aug. 21, 2001

(54) TRANSFORMER WINDING

(75) Inventors: Philip J. Hopkinson; Dilip R. Purohit, both of Charlotte; Gary D. King, Matthews, all of NC (US)

(73) Assignee: Square D Company, Palatine, IL (US)

( * ) Notice: Subject to any disclaimer, the term of this patent is extended or adjusted under 35 U.S.C. 154(b) by 0 days.

(21) Appl. No.: 09/378,786

(22) Filed: Aug. 23, 1999

(51) Int. Cl.[7] ..... H01F 27/28
(52) U.S. Cl. ..... 336/225; 336/223; 336/231
(58) Field of Search ..... 336/222, 223, 336/225, 231, 212

(56) References Cited

U.S. PATENT DOCUMENTS 683,954 * 10/1901 Liebreich ..... 336/212
2,159,534 * 5/1939 Ruska ..... 336/225
2,482,489 * 9/1949 Kaiser ..... 336/222
2,485,666 * 10/1949 Silver ..... 335/223
2,500,766 * 3/1950 Obert et al. ..... 336/222
3,573,694 * 4/1971 Fange ..... 336/198
3,728,655 * 4/1973 Reinke ..... 336/62
3,747,038 7/1973 McGill .
3,947,795 3/1976 Donnelly et al. .
4,066,955 1/1978 Suthers .
5,396,210 3/1995 Purohit et al. .
5,584,438 12/1996 Jagersberger .
5,621,372 4/1997 Purohit .
5,818,226 * 10/1998 Aizawa ..... 324/258
5,860,207 1/1999 Knight et al. .

* cited by examiner

*Primary Examiner*—Lincoln Donovan
*Assistant Examiner*—Tuyen T. Nguyen
(74) *Attorney, Agent, or Firm*—Larry I. Golden; Michael J. Femal

(57) ABSTRACT

A transformer including a core having first and second portions, and first and second primary winding sections. The first primary winding section includes a plurality of winding layers ($L_1$–$L_n$) about the first portion of the core, and the second primary winding section includes a plurality of winding layers ($L_1$–$L_n$) about the second portion of the core. Corresponding winding layers of the first and second winding sections are separated by a distance ($D_1$–$D_n$). The distance ($D_1$–$D_n$) between the corresponding layers of first and second primary winding sections increases as the number of winding layers ($L_1$–$L_n$) increases.

19 Claims, 3 Drawing Sheets

TRANSFORMER WINDING

TECHNICAL FIELD

The present invention relates generally to transformers and, more particularly, to transformer windings and processes for producing a double axial winding.

BACKGROUND OF THE INVENTION

Transformers are used extensively in electrical and electronic applications. Transformers are useful to step voltages up or down, to couple signal energy from one stage to another, and for impedance matching. Transformers are also useful for sensing current and powering electronic trip units for circuit interrupters such as circuit breakers and other electrical distribution devices. Generally, the transformer is used to transfer electric energy from one circuit to another circuit using magnetic induction.

A transformer includes two or more multi-turned coils of wire placed in close proximity to cause a magnetic field of one coil to link to a magnetic field of the other coil. Most transformers have a primary winding and a secondary winding. By varying the number of turns contained in the primary winding with respect to the number of turns contained in the secondary winding, the output voltage of the transformer can be easily increased or decreased.

The magnetic field generated by the current in the primary coil or winding may be greatly concentrated by providing a core of magnetic material on which the primary and secondary coils are wound. This increases the inductance of the primary and secondary coils so that a smaller number of turns may be used. A closed core having a continuous magnetic path also ensures that practically all of the magnetic field established by the current in the primary coil will be induced in the secondary coil.

When an alternating voltage is applied to the primary winding, an alternating current flows, limited in value by the inductance of the winding. This magnetizing current produces an alternating magnetomotive force which creates an alternating magnetic flux. The flux is constrained within the magnetic core of the transformer and induces voltage in the linked secondary winding, which, if it is connected to an electrical load, produces an alternating current. This secondary load current then produces its own magnetomotive force and creates a further alternating flux which links back with the primary winding. A load current then flows in the primary winding of sufficient magnitude to balance the magnetomotive force produced by the secondary load current. Thus, the primary winding carries both magnetizing and load current, the secondary winding carries load current, and the magnetic core carries only the flux produced by the magnetizing current.

In producing a primary winding for a transformer, conventionally, a winding mandrel winds a conductor wire around a secondary winding on the transformer core. This produces a formation of primary voltage coils on the transformer core. Typically, the conductor wire of the primary winding comprises an insulated wire having a flat cross section. In conventional transformers, the primary winding is wound around the transformer core in a helical manner, proceeding back and forth about each end of the transformer core. Each helical layer rests entirely upon the next layer closer to the transformer core because each subsequent helical layer extends the same length as all prior layers. This provides for a relatively poor conductor space factor within the core window. Additionally, the close proximity of the various layers of conductor wires does not assist in preventing arcing between the layers.

Accordingly, a transformer core in accordance with the present invention provides an inexpensive and simple solution to eliminate the drawbacks of the prior transformer windings.

SUMMARY OF THE INVENTION

The transformer of the present invention is adapted to provide a transformer core having a winding of coils therearound which is simple to manufacture, has a higher space factor, and provides for outside connection locations of the taps and line leads. Generally, the transformer core has an outer surface, a first end, a second end, and a midpoint. The coiled layers are wound around the transformer core such that increasing layers located a distance radially further from the outer surface of the transformer core are shorter in overall length than the layer of coils located a distance radially closer to the outer surface of the transformer core. The transformer setup of the present invention is adapted to be utilized in conjunction with primary and secondary coil windings to cause a magnetic field of one coil to link to, or cause, a magnetic field in the other coil.

According to one aspect of the present invention, layers of coils extend on both the first and second ends of the transformer core. A first layer of coils extends from a location $Z_1'$ proximal the midpoint of the transformer core to a location proximal the first end of the transformer core, and a corresponding first layer of coils extends from a location $Z_1$ proximal the midpoint of the transformer core to a location proximal the second end of the transformer core. A second layer of coils extends from a location proximal the first end of the transformer core to a location $Z_2$ proximal the midpoint of the transformer core, and a corresponding second layer of coils extends from the location proximal the second end of the transformer core to a location $Z_2'$ proximal the midpoint of the transformer core. A third layer of coils extends from a location $Z_3$ proximal the midpoint of the transformer core to a location proximal the first end of the transformer core, and a corresponding third layer of coils extends from the location proximal the second end of the transformer core to a location $Z_3'$. This continues until an $n^{th}$ layer of coils extends from the location proximal the respective ends of the transformer core to a location $Z_n$ and $Z_n'$, respectively. In this configuration, location $Z_1$ and $Z_1'$ is closer to the midpoint of the transformer core than location $Z_2$ and $Z_2'$; location $Z_2$ and $Z_2'$ is closer to the midpoint of the transformer core than location $Z_3$ and $Z_3'$; and so on and so forth, such that location $Z_n$ and $Z_n'$ is further from the midpoint of the transformer core than location $Z_{n+1}$ and $Z_{n+1}'$.

According to another aspect of the present invention, the distance between the midpoint of the transformer core and the location $Z_1$ is substantially equal to the distance between the midpoint of the transformer core and the location $Z_1'$. Similarly, the distance between the midpoint of the transformer core and the location $Z_2$ is substantially equal to the distance between the midpoint of the transformer core and the location $Z_2'$. This continues until finally the distance between the midpoint of the transformer core and the location $Z_n$ is substantially equal to the distance between the midpoint of the transformer core and the location $Z_n'$.

According to another aspect of the present invention, a first primary winding section comprises a plurality of winding layers ($L_1$–$L_n$) about the first portion or end of the magnetic core, and a second primary winding section comprises a plurality of winding layers ($L_1$–$L_n$) about the second portion or end of the magnetic core. The corresponding winding layers of the first and second winding sections are separated by a distance ($Z_1$–$Z_n$). And, the distance ($Z_1$–$Z_n$) increases as the number of winding layers ($L_1$–$L_n$) increases.

According to another aspect of the present invention, the first winding section and the second winding section comprise conductive elements that are electrically connected substantially adjacent a midpoint of the magnetic core.

According to another aspect of the present invention, a first set of sequential taps are connected at spaced positions about the first primary winding section, and a second set of sequential taps are connected at spaced positions about the second primary winding section. Generally, the spacing between the sequential taps connected to the first primary winding section is equal to the spacing between the sequential taps connected to the second primary winding section. The taps are located on an outside of the winding sections.

According to yet another aspect of the present invention, a first line terminal is link-connectible to the taps connected to the first primary winding section, and a second line terminal is link-connectible to the taps connected to the second primary winding section.

Other features and advantages of the invention will be apparent from the following specification taken in conjunction with the following drawings.

DETAILED DESCRIPTION OF THE PREFERRED EMBODIMENT

Figure 1:
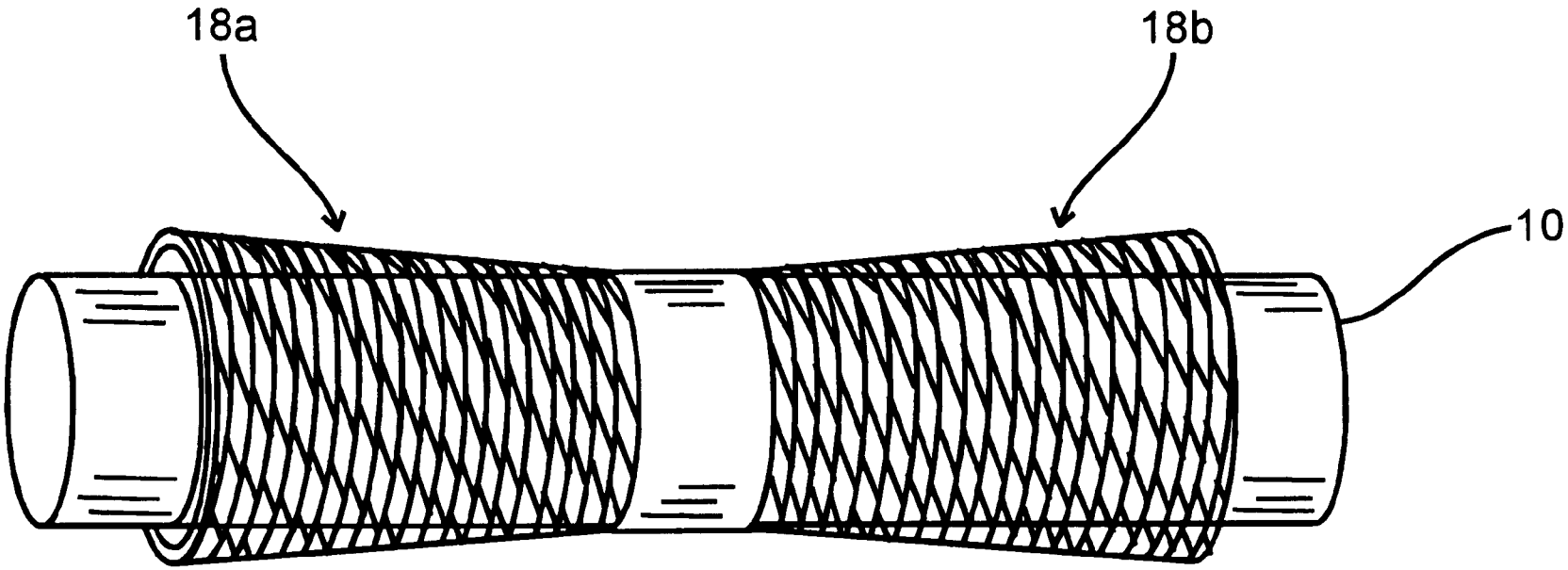
FIG. 1 is a perspective view illustratively showing a transformer core with variably spaced distances between first and second coil windings.

While this invention is susceptible of embodiments in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated.

Figure 2:
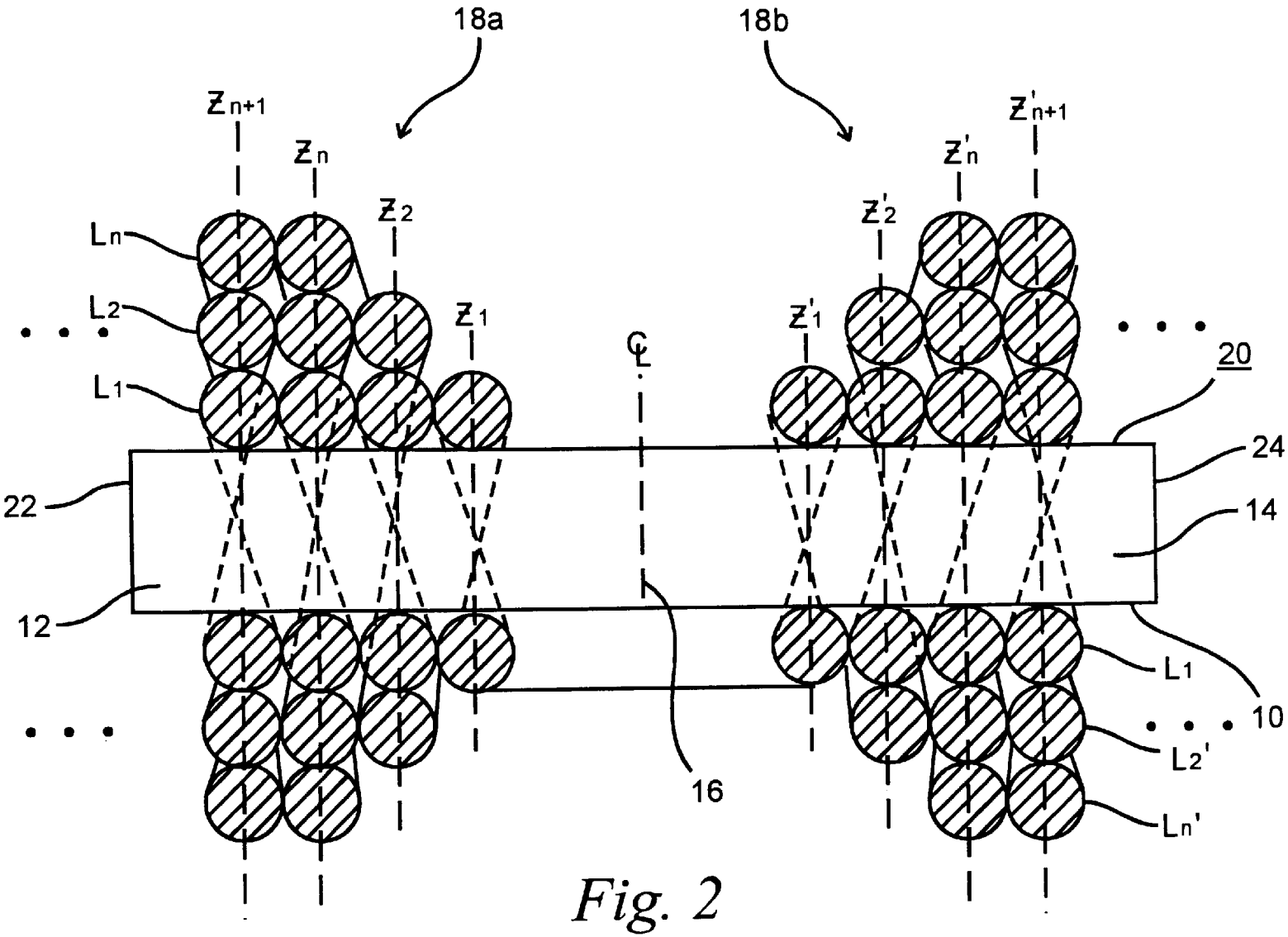
FIG. 2 is a partial cross-sectional view of the transformer core and coil windings of the present invention; and, FIG. 3 is a schematic presentation of the transformer core and coil windings of the present invention.

Referring now in detail to the Figures, and initially to FIG. 2, there is shown a transformer leg or core 10 having a first end or portion 12, a second end or portion 14, and a longitudinal midpoint 16. The midpoint 16 is measured about the length of the core 10. The core 10 includes a secondary winding 17 already wound around the core 10. A primary coil or winding 18 is wound about the outer surface 20 of each end 12, 14 of the transformer core 10. Generally, the primary winding 18 is wound over the secondary windings 17. The coil windings are coaxially positioned about and radially outwardly of the transformer core. The transformer core 10 is generally a magnetic core 10. Additionally, the secondary windings 17 may be an integral part of the magnetic transformer core 10. Typical primary voltages range from 4.164 kV to 25 kV.

Figure 3:
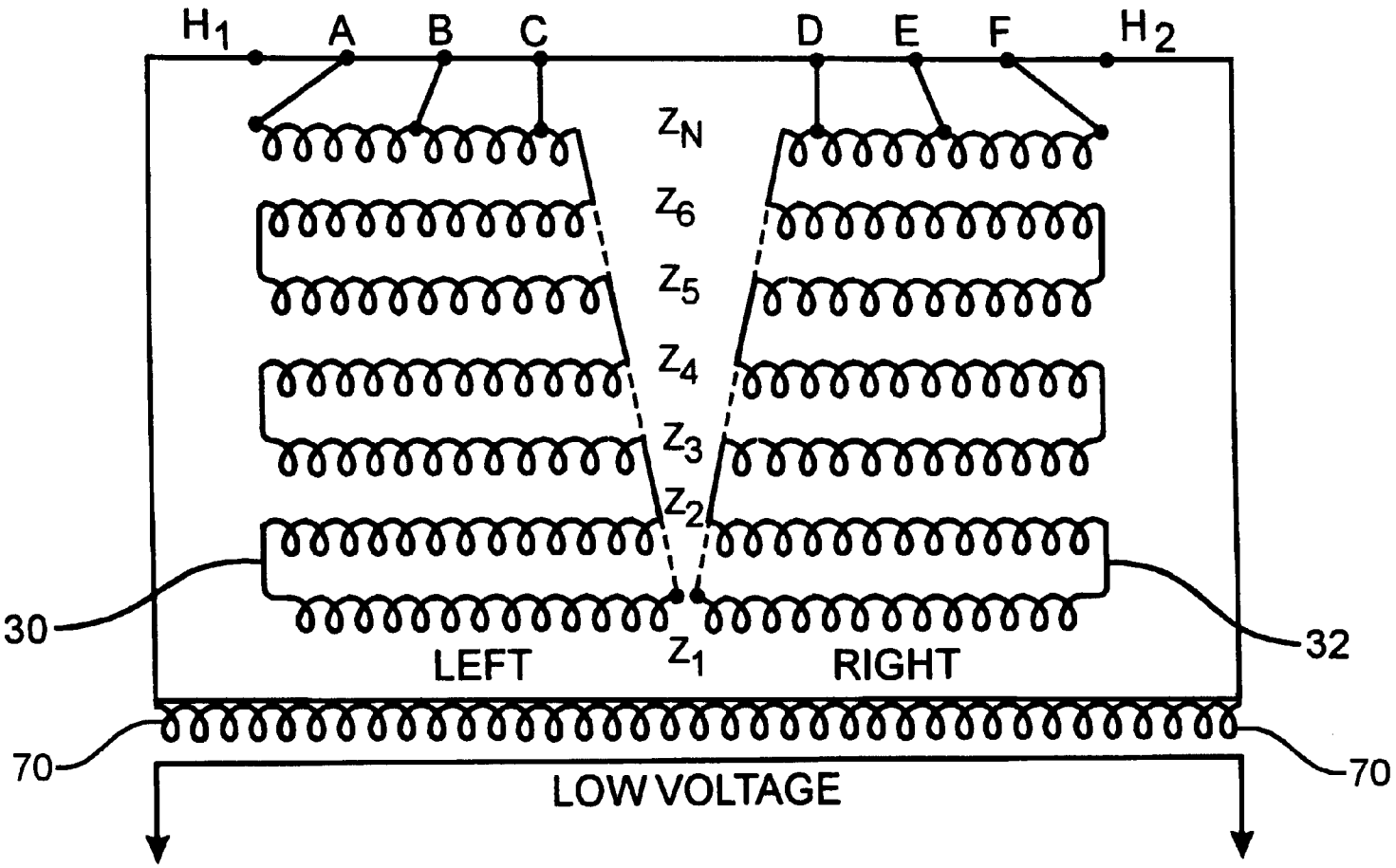

The primary coils 18 are formed of a plurality of windings of a conductive element wound around the transformer core 10 in coiled layers $L_1$ through $L_n$. As generally illustrated in FIG. 1, and as illustrated with greater partial detail in FIG. 2, a first section 18*a* of a plurality of coiled winding layers ($L_1$–$L_n$) is wound around the first end 12 of the transformer core 10 and has a length about the transformer core 10, and a second section 18*b* of a plurality of coiled winding layers ($L_1'$–$L_n'$) is wound around the second end 14 of the transformer core 10 and has a length about the transformer core 10. FIG. 2 and the schematic of FIG. 3, illustrate that coiled layers (L) located a distance further from an outer surface 20 of the transformer core 10 are shorter in length than layers (L) located a distance closer to the outer surface 20 of the transformer core 10. That is, progressive layers of coils are shorter in length than prior layers of coils. This provides for a greater space factor for the transformer.

Concerning the plurality of coiled layers ($L_1$–$L_n$) about the first end 12 of the transformer core 12, a first coil layer $L_1$ extends from the end 22 of the first end 12 of the transformer core 10 to a location $Z_1$ proximal the midpoint 16 of the transformer core 10; a second coil layer $L_2$ extends from the end 22 of the first end 12 of the transformer core 10 to a location $Z_2$ proximal the midpoint 16 of the transformer core 10; a third coil layer $L_3$ extends from the end 22 of the first end 12 of the transformer core 10 to a location $Z_3$ proximal the midpoint 16 of the transformer; and, subsequent coil layers $L_n$ extend from the end 22 of the first end 12 of the transformer core 10 to a location $Z_n$ on the transformer core proximal the longitudinal midpoint 16 of the transformer core 10. Further, FIGS. 2 and 3 demonstrate that location $Z_1$ is closer to the longitudinal midpoint 16 of the transformer core 10 than location $Z_2$, that location $Z_2$ is closer to the longitudinal midpoint 16 of the transformer core 10 than location $Z_3$, and that in general, location $Z_{n-1}$ is closer to the longitudinal midpoint 16 of the transformer core 10 than location $Z_n$.

Likewise, concerning the plurality of coiled layers ($L_1'$–$L_n'$) about the second end 14 of the transformer core 10, a first coil layer $L_1'$ extends from the end 24 of the second end 14 of the transformer core 10 to a location $Z_1'$ proximal the midpoint 16 of the transformer core 10; a second coil layer $L_2'$ extends from the end 24 of the second end 14 of the transformer core 10 to a location $Z_2'$ proximal the midpoint 16 of the transformer core 10; a third coil layer $L_3'$ extends from the end 24 of the second end 14 of the transformer core 10 to a location $Z_3'$ proximal the midpoint 16 of the transformer; and, subsequent coil layers $L_n'$ extend from the end 24 of the second end 14 of the transformer core 10 to a location $Z_n'$ proximal the midpoint 16 of the transformer core 10. Similarly, FIGS. 2 and 3 demonstrate that location $Z_1'$ is closer to the midpoint 16 of the transformer core 10 than location $Z_2'$, that location $Z_2'$ is closer to the midpoint 16 of the transformer core 10 than location $Z_3'$, and that in general, location $Z_{n-1}'$ is closer to the midpoint 16 of the transformer core 10 than location $Z_n'$.

Each of the individual layers ($L_1$–$L_n$, and $L_1'$–$L_n'$) of the plurality of layers of coil windings on the first and second portions 12,14 of the transformer core 10 generally mirror the corresponding layer on the opposing portion 12,14 of the transformer core 10. Accordingly, layer $L_1$ generally mirrors layer $L_1'$, and so on and so forth. As such, the distance between the midpoint 16 of transformer core 10 and location $Z_1$ is substantially equal to the distance between the midpoint 16 of the transformer core 16 and location $Z_1'$. Furthermore, as a general rule, the distance between the midpoint 16 of transformer core 10 and location $Z_n$ is substantially equal to the distance between the midpoint 16 of the transformer core 10 and location $Z_n'$.

Each coil layer about the first end 12 of the transformer core 10 generally extends from the area proximal the end 22 of the first end 12, and each coil layer about the second end 14 of the transformer core 10 generally extends from the area proximal the end 24 of the second end 14 of the transformer core 10. And, as explained above, subsequent coil layers $L_n$, $L_n'$ about each end 12,14 of the transformer core 10 are generally shorter in length than prior coil layers $L_{n-1}$,$L_{n-1}'$, respectively. Accordingly, the distance between $Z_2'$ and $Z_2$ is greater than the distance between $Z_1'$ and $Z_1$. Similarly, the distance between $Z_3'$ and $Z_3$ is greater than the distance between $Z_2'$ and $Z_2'$. Likewise, in general, the distance between $Z_n'$ and $Z_n$ is greater than the distance between $Z_{n-1}'$ and $Z_{n-1}'$. In sum, the distance between corresponding winding layers of the first and second winding sections increases as the number of winding layers increases.

Generally, the voltage difference between the corresponding winding layers increases with additional windings. Thus, the present invention provides that the distance between the corresponding layers of the first primary winding section 18*a* and the second primary winding section 18*b* preferably increases to prevent arcing between the wires. In sum, the distance between an end of the first layer of coils, $Z_n$, adjacent the first end 22 of the transformer core 10 and an end of the first layer of coils, $Z_n'$, adjacent the second end 24 of the transformer core 10 is less than the distance between the end of the second layer of coils, $Z_{n+1}$, adjacent the first end 22 of the transformer core 10 and an end of the second layer of coils, $Z_{n+1}'$, adjacent the second end 24 of the transformer core 10.

The layer of primary coils ($L_{1-Ln}$) adjacent the end 22 of the first portion 12 of the transformer core 10 are also known as the first primary winding section 18*a*. Similarly, the layer of primary coils ($L_1'$–$L_n'$) adjacent the end 24 of the second portion 14 of the transformer core 10 are also known as the second primary winding section 18*b*.

Sequential taps (a,b,c) are connected at spaced positions about the first primary winding section 18*a*, and sequential taps (d,e,f) are connected at spaced positions about the second primary winding section 18*b*. Generally, sequential taps have one more winding turn than prior taps on the winding, or, conversely, sequential taps have one less winding turn than prior taps. As such, the different taps allow the voltage difference to be varied. The spacing between the sequential taps (a,b,c) connected to the first primary winding section 18*a* is generally equal to the spacing between the sequential taps (d,e,f) connected to the second primary winding section 18*b*, for consistency purposes. Each of the taps (a,b,c,d,e,f) are preferably located on an outside of the respective winding sections. After the taps (a,b,c,d,e,f) are in place, a first line terminal ($H_1$) is link-connectible to the taps (a,b,c) connected to the first primary winding section 18*a*, and a second line terminal ($H_2$) is link-connectible to the taps connected to the second primary winding section 18*b*.

In manufacturing the transformer core 10 with the primary winding sections 18 as identified above, a first conductive element 30 and a second conductive element 32 are provided. The first conductive element 30 forms the winding layers adjacent the first end 12 of the transformer core 10, and the second conductive element 32 forms the winding layers adjacent the second end 14 of the transformer core 10. The conductive elements 30,32 generally comprise insulated wires, with either a circular or flat shape thereto. Typical wire dimensions include 0.1"×0.3"and 0.25"×1".

The first conductive element 30 is wound on the first side 12 of the transformer core 10 in successive layers ($L_n$) from a winding mandrel such that subsequent layers ($L_{n+1}$) are on the outside or top of prior layers. Additionally, the subsequent layers ($L_{n+1}$) do not extend the full length of prior layers ($L_n$). Specifically, as identified above, an end of the successive layers is farther away from the midpoint 16 of the transformer core than the end of prior successive layers. The first layer $L_1$ is wound radially closest to the outer surface 20 of the transformer core 10. The leading end of the first layer $L_1$ of the first conductive element 30 remains accessible for further processing. The first conductive element 30 is wound around the transformer core 10 in generally a helical manner, from an area proximal the midpoint 16 of the transformer core 10 to an area adjacent the end of the first end 12 of the transformer core 10, back toward the midpoint 16 of the transformer core 10, back toward the area adjacent the end of the first end 12 of the transformer core, and so on and so forth, until a plurality of layers are wound around the first portion 12 of the transformer core.

Next, the second conductive element 32 is wound radially around the second side 14 of the transformer core 10 in layers ($L_n'$) such that subsequent layers ($L_{n+1}'$) are on the outside or top of prior layers. Additionally, the subsequent layers ($L_{n+1}'$) do not extend the full length of prior layers ($L_n'$). The first layer $L_1'$ is wound closest to the outer surface 20 of the transformer core 10. The leading end of the second conductive element 32 remains accessible and adjacent the leading end of the first conductive element 30 for connecting the first and second winding sections 18*a*, 18*b* substantially adjacent the midpoint 16 of the transformer core 10. The second conductive element 32 is wound around the transformer core 10 in generally a helical manner, from an area proximal the midpoint 16 of the transformer core 10 to an area adjacent the end of the second end 14 of the transformer core 10, back toward the midpoint 16 of the transformer core 10, back toward the area adjacent the end of the second end 14 of the transformer core, and so on and so forth, until a plurality of layers are wound around the second portion 14 of the transformer core. The second winding section 18*b* may be reverse wound, or the core may be reversed in which case the second winding section 18*b* is wound similar to the first winding section 18*a*.

The distance between adjacent successive layers of windings on the first and second sides 12,14 of the transformer core 10 increases as the number of layers of windings increases on the transformer core 10.

Finally, the leading end of the first conductive element 30 is connected to the leading end of the second conductive element 32 via crimping, welding, or by some other connection means. The windings are split to provide a more balanced impedance and to decrease the axial forces.

While the specific embodiment has been illustrated and described, numerous modifications come to mind without significantly departing from the spirit of the invention, and the scope of protection is only limited by the scope of the accompanying Claims.

We claim:

1. A coil for a transformer comprising:

a transformer core having a first end, a second end, and a longitudinal midpoint;

a first winding on the transformer core comprising a conductive element wound around the transformer core in a plurality of coiled layers, a first layer of the first winding extending from a starting point at a location Z1 proximal the longitudinal midpoint of the transformer core to a location proximal the first end of the transformer core, a second layer of the first winding, successive of the first layer, extending from the location proximal the first end of the transformer core to a location Z2 proximal the longitudinal midpoint of the transformer core, a third layer of the first winding, successive of the second layer, extending from the location proximal the first end of the transformer core to a location Z3 proximal the longitudinal midpoint of the transformer wherein location Z1 is closer to the longitudinal midpoint of the transformer core than location Z2, and wherein location Z2 is closer to the longitudinal midpoint of the transformer core than location Z3; and a second winding on the transformer core comprising a conductive element wound around the transformer core in a plurality of coiled layers, a first layer of the second winding extending from a starting point at a location Z1' proximal the longitudinal midpoint of the transformer core to a location proximal the second end of the transformer core, a second layer of the second winding, successive of the first layer, extending from the location proximal the second end of the transformer core to a location Z2' proximal the longitudinal midpoint of the transformer core, a third layer of the second winding, successive of the second layer, extending from the location proximal the second end of the transformer core to a location Z3' proximal the longitudinal midpoint of the transformer, wherein location Z1' is closer to the midpoint of the transformer core than location Z2', and wherein location Z2' is closer to the midpoint of the transformer core than location Z3', wherein sequential taps are connected at spaced positions about the first winding and sequential taps are connected at spaced positions about the second winding, the spacing between the sequential taps connected to the first winding being equal to the spacing between the sequential taps connected to the second winding.

2. The coil as in claim 1 wherein the distance between the longitudinal midpoint of the transformer core and the location Z1 is approximately equal to the distance between the longitudinal midpoint of the transformer core and the location Z1'.

3. The coil as in claim 2 wherein the distance between the longitudinal midpoint of the transformer core and the location Z2 is approximately equal to the distance between the longitudinal midpoint of the transformer core and the location Z2', and wherein the distance between Z2 and Z2' is greater than the distance between Z1 and Z1'.

4. The coil as in claim 3 wherein the distance between the longitudinal midpoint of the transformer core and the location Z3 is substantially equal to the distance between the longitudinal midpoint of the transformer core and the location Z3', and wherein the distance between Z3 and Z3' is greater than the distance between Z2 and Z2'.

5. A coil around a transformer core, the transformer core having an outer surface, a first end, a second end, and a midpoint, the coil comprising:

a plurality of coiled layers wound around a length of the transformer core wherein increasing layers located a distance further from an outer surface of the transformer core are shorter in length than a layer located a distance closer to the outer surface of the transformer core, wherein sequential taps are connected at spaced positions about each of the plurality of coiled layers, the spacing between the sequential taps connected to one of the plurality of coiled layers being equal to the spacing between the sequential taps connected to another of the plurality of coiled layers.

6. The coil as in claim 5, further comprising a first and second layer of coil windings adjacent the first end of the transformer core, and a first and second layer of coil windings adjacent the second end of the transformer core, wherein a distance between an end of the first layer of coil windings adjacent the first end of the transformer core and an end of the first layer of coil windings adjacent the second end of the transformer core is less than the distance between an end of the second layer of coil windings adjacent the first end of the transformer core and an end of the second layer of coil windings adjacent the second end of the transformer core.

7. A transformer comprising:

a core having a first portion joined to a second portion at a longitudinal midpoint of the core;

a first primary winding section comprising a plurality n of winding layers L1, L2, . . . Ln about the first portion of the core;

a second primary winding section comprising a plurality n of winding layers L1, L2, . . . Ln about the second portion of the core, wherein corresponding winding layers of the first and second winding sections are separated by a distance respectively;

wherein the distance D1, D2, . . . Dn, increases as the number of winding layers L1, L2, . . . Ln increases; and wherein sequential taps are connected at spaced positions about the first winding section and sequential taps are connected at spaced positions about the second winding section, the spacing between the sequential taps connected to the first winding section being equal to the spacing between the sequential taps connected to the second winding section.

8. The transformer of claim 7, wherein the first primary winding section and the second primary winding section comprise conductive elements that are electrically connected adjacent the longitudinal midpoint of the magnetic core.

9. The transformer of claim 7, wherein the first primary winding section is a mirror image of the second primary winding section.

10. The transformer of claim 8, wherein the sequential taps are located on an outside of the winding sections.

11. The transformer of claim 8, further comprising a first line terminal connectable by a conductive link to the sequential taps connected to the first primary winding section, and a second line terminal connectable by a conductive link to the sequential taps connected to the second primary winding section.

12. A transformer comprising:

a magnetic core; and, a primary winding about the magnetic core, wherein the primary winding comprises a first section of coils and a second section of coils, the first and second sections having a plurality of winding layers, wherein layers of the first section are separated from respective layers of the second section by a distance, and wherein the distance between the separated layers increases as the number of winding layers increases, wherein sequential taps are connected at spaced positions about the first section of the primary winding and sequential taps are connected at spaced positions about the second section of the primary winding, the spacing between the sequential taps connected to the first section of the primary winding being equal to the spacing between the sequential taps connected to the second section of the primary winding.

13. The transformer of claim 12, wherein the winding layers of the second section are reverse wound from the winding layers of the first section.

14. The transformer of claim 12, wherein the first section comprises a coil and the second section comprises a coil, and wherein the coils are electrically connected.

15. The transformer of claim 14, wherein a first layer of the first section is electrically connected to a first layer of the second section adjacent a longitudinal midpoint of the transformer magnetic core.

16. The transformer of claim 12, wherein the sequential taps are brought out to a location outside of the first and second primary winding sections.

17. The transformer of claim 12, further comprising a first line terminal connectable by a conductive link to the sequential taps connected to the first primary winding section, and a second line terminal connectable by a conductive link to the sequential taps connected to the second primary winding section.

18. A method for winding a coil on a transformer core comprising the steps of:

providing a transformer core, a first conductive element, and a second conductive element, wherein sequential taps are connected at spaced positions about the first conductive element and sequential taps are connected at spaced positions about the second conductive element, the spacing between the sequential taps connected to the first conductive element being equal to the spacing between the sequential taps connected to the second conductive element;

winding the first conductive element on a first side of the transformer core in layers such that subsequent layers are on top of prior layers, and such that subsequent layers extend less than the full length of prior layers;

winding the second conductive element on a second side of the transformer core in layers such that subsequent layers are on top of prior layers, and such that subsequent layers extend less than the full length of prior layers; and electrically connecting the first conductive element to the second conductive element.

19. A method of manufacturing a coil around a transformer core comprising the steps of:

winding the coil around a first side of a midpoint of the transformer core in successive layers, wherein an end closest to the midpoint of the transformer core of the successive layers is further away from the midpoint of the transformer core than the end closest to the midpoint of the transformer core of prior successive layers around the first side of the transformer core; and winding the coil around a second side of the midpoint of the transformer core in successive layers, wherein the end closest to the midpoint of the transformer core of the successive layers is further away from the midpoint of the transformer core than the end closest to the midpoint of the transformer core of prior successive layers around the second side of the transformer core, such that a distance between adjacent successive layers of windings on the first and second side of the transformer core increases as the number of layers of windings increases on the transformer core, wherein sequential taps are connected at spaced positions about the first side and sequential taps are connected at spaced positions about the second side, the spacing between the sequential taps connected to the first side being equal to the spacing between the sequential taps connected to the second side.

* * * * *